US007758352B2

(12) United States Patent
Zeng

(10) Patent No.: US 7,758,352 B2
(45) Date of Patent: Jul. 20, 2010

(54) ELECTRICAL CONNECTOR

(75) Inventor: Qingyong Zeng, Jiangsu (CN)

(73) Assignee: Jiangsu Famfull Electronics Co. Ltd. (CN)

( * ) Notice: Subject to any disclaimer, the term of this patent is extended or adjusted under 35 U.S.C. 154(b) by 113 days.

(21) Appl. No.: 12/137,330

(22) Filed: Jun. 11, 2008

(65) Prior Publication Data

US 2009/0023312 A1 Jan. 22, 2009

(30) Foreign Application Priority Data

Jun. 11, 2007 (CN) ..... 2007 2 0038351 U

(51) Int. Cl.
*H01R 24/00* (2006.01)

(52) U.S. Cl. ..... 439/74; 439/346

(58) Field of Classification Search ..... 439/74, 439/346, 660

See application file for complete search history.

(56) References Cited

U.S. PATENT DOCUMENTS 5,641,290 A * 6/1997 Yagi ..... 439/74
5,975,916 A * 11/1999 Okura ..... 439/74
7,367,816 B2 * 5/2008 Liu ..... 439/74
7,425,158 B2 * 9/2008 Ookura ..... 439/660
2002/0187666 A1 * 12/2002 Harasawa et al. ..... 439/74
2006/0199403 A1 * 9/2006 Tsai ..... 439/74
2006/0234525 A1 * 10/2006 Ookura ..... 439/74
2007/0020966 A1 * 1/2007 Lee et al. ..... 439/74
2007/0105408 A1 * 5/2007 Ookura ..... 439/74
2007/0275575 A1 * 11/2007 Wang ..... 439/74

* cited by examiner

*Primary Examiner*—Gary F. Paumen
(74) *Attorney, Agent, or Firm*—Vidas, Arrett & Steinkraus, P.A.

(57) ABSTRACT

In some embodiments, an electrical connector comprises a male body and a female body. The male body comprises a first insulating base and a plurality of male terminals. Each male terminal includes a male contact. The female body comprises a second insulating base and a plurality of female terminals. Each female terminal includes a female contact arranged to engage a male contact so as to form a circuit. The male contact is formed with a protrusion extending from a side surface. The female contact is bent to form an arc-shaped convex surface that abuts the male contact, and engages the protrusion of the male contact.

18 Claims, 8 Drawing Sheets

ELECTRICAL CONNECTOR

CROSS-REFERENCE TO RELATED APPLICATIONS

This application claims the benefit of Chinese Patent Application No. CN200720038351.7, filed Jun. 11, 2007, the entire disclosure of which is hereby incorporated herein by reference.

FIELD OF THE INVENTION

The present invention relates to an electrical connector, and more particularly to an electrical connector that connects two different wire stocks or a wire stock and a flexible printed circuit (FPC).

BACKGROUND OF THE INVENTION

At present, a majority of the board-to-board (BTB) electrical connector product series have terminal interval exceeding 0.4 mm and their height above 1.2 mm. Electronic products characterized in their small size necessitate to be smaller connector. However, due to technical difficulties, smaller-sized connector is still unavailable in the market.

The U.S. Pat. No. 5,975,916 disclosed a low-profile BTB electrical connector, which is composed of a plug having a plurality of terminals parallel to each other, an insulating base receiving such terminals, and a socket. Each terminal has contact arm and fixture arm arranged in a "Ⅎ" shaped terminal slot of the insulating base. At two opposite sidewalls of the fixture arm stripped horns and thorns are formed to lock the terminals in the insulating base. However, the interval between terminals is quite small and the sidewall of the terminal slots are thin, resulting in tiny horns and thorns formed, which ultimately leads to unstable connection of the terminals of the socket and the terminals of the plug. To meet the miniaturization requirements of the electronic products, it is quite necessary to provide an electrical connector with a tiny volume and high connection stability.

All U.S. patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

Accordingly, to overcome the disadvantages above-mentioned, the present invention is to provide an electrical connector catering to miniaturization requirement with a tiny volume and high connection stability.

The present invention provides an electrical connector with following technical features as:

An electrical connector comprises a male body including a first insulating base and a plurality of male terminals arranged in said first insulating base, each male terminal having a male contact; a female body including a second insulating base and a plurality of female terminals arranged in said second insulating base, each female terminal having a female contact engaging with said male contact so that the external circuit is made through. The male contact is formed with a protrusion at its side surface, the end of said female contact facing said male contact is bended to form an arc shaped convex which contacts with the male contact and engages with said protrusion in a locking manner.

The second insulating base is formed with slopes at the inner sides of its two opening ends facing the male body, said slopes inclining towards the center of the second insulating base from top to bottom; the first insulating base possesses inverted round corners at its outside facing two opening ends of the second insulating base.

On the second insulating base a first rib is mounted having first grooves, and the first insulating base is formed with a second groove having bulges projecting thereof, said first rib engaging with the second groove tightly, said bulges engaging tightly with said first groove.

The side surface of each male contact facing female contact projects out to form said protrusion and a recess above said protrusion is formed at said side surface for reception of part of said convex, the lower part of said convex pressing against said protrusion.

The protrusion is formed with a first slope inclining towards said convex from bottom to top, and said convex is formed with a second slope inclining towards the male contact form top to bottom.

The female contact is becoming narrower gradually from the end distant from said convex to the other end. Each said male terminal further includes a male lead having a head extending outwardly from the first insulating base and a tail stationed on the first insulating base, the male lead extending from one end of said male contact in a bending direction, and a male arm formed with another end of said male contact bended forward and then bended back.

The first insulating base is formed with steps at its joints with said male lead. The male contact together with said male arm forms a closed ring which is fixed in the trough set at the underside distant from said female body of the first insulating base.

The female terminal further includes an invert U-shaped female arm extending from the outer end of said female contact in a direction opposite to said male contact, a female lead extending from the end of said female arm in a direction opposite to said male contact with one end extending outwardly from said second insulating base, said second insulating base possesses a plurality of terminal slots set along its longitudinal direction for reception of said female arm. The female arm is formed with teeth at its side surface for tight cooperation with sidewalls of said terminal slot.

Compared with the prior art, the present invention has advantages as follows:

Each male contact is formed with a protrusion and each female contact possesses an convex, which is arc shaped so that it can contacts with the male contact and at the same time engages with the protrusion in a locking manner leading to a close and reliable connection between male terminals and female terminals. In addition, since the female terminal is arc shaped, the overall length of the female terminal is reduced, which makes the miniaturization of an electrical connector possible.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

Figure 1:
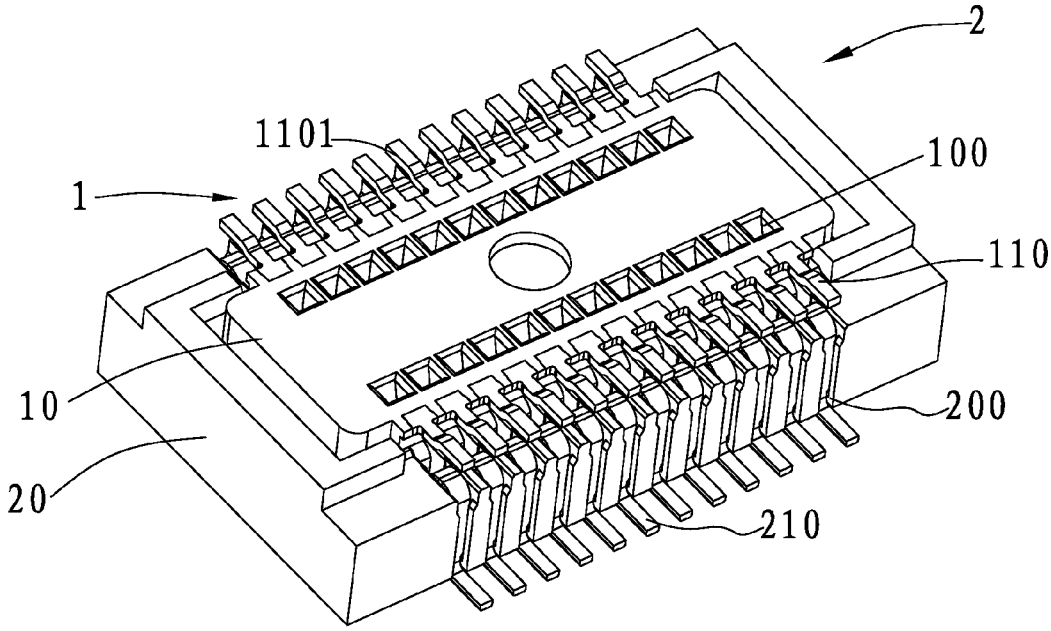
FIG. 1 is a perspective view of the electrical connector according to the present invention.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
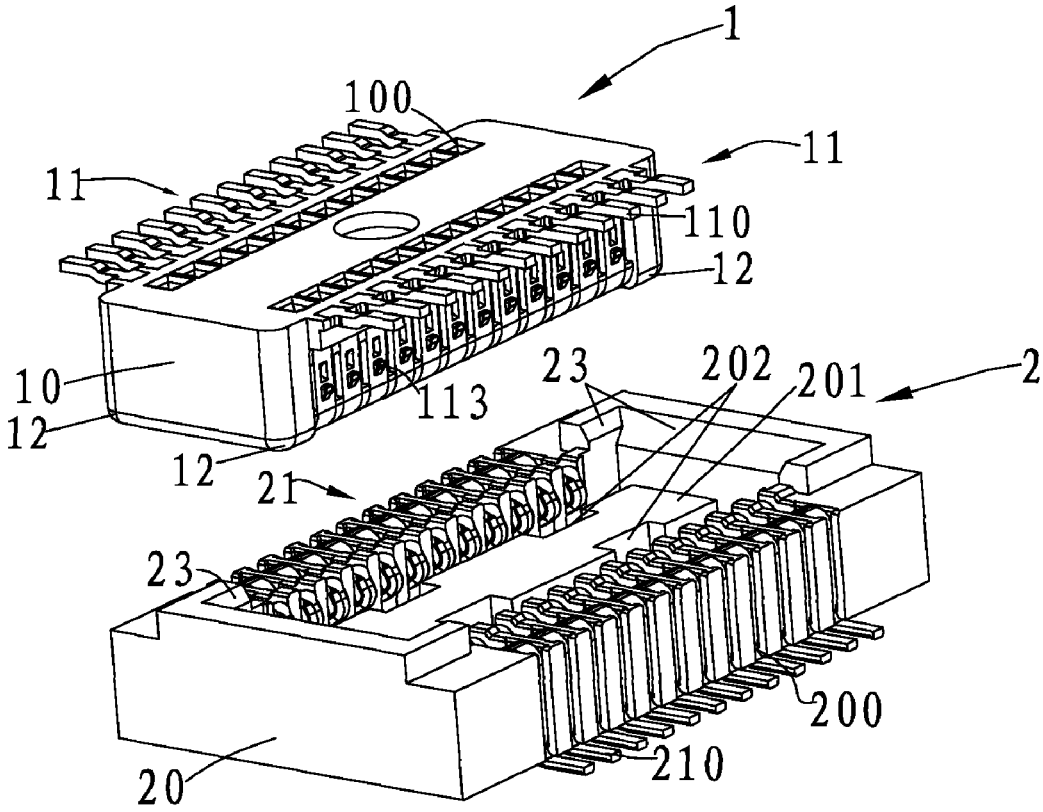
FIG. 2 is a schematic view of the male body and female body prior to their connection in accordance with the present invention.
Figure 3:
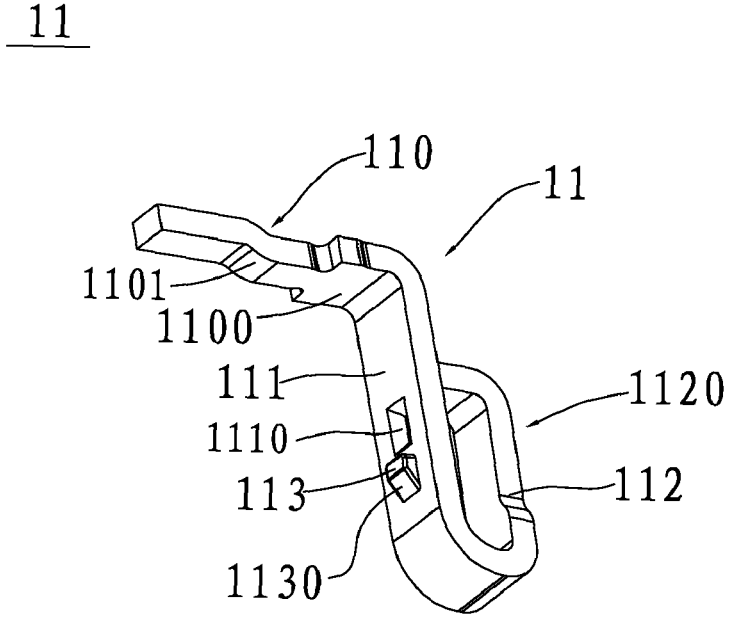
FIG. 3 is a schematic view of a male terminal in accordance with the present invention.
Figure 4:
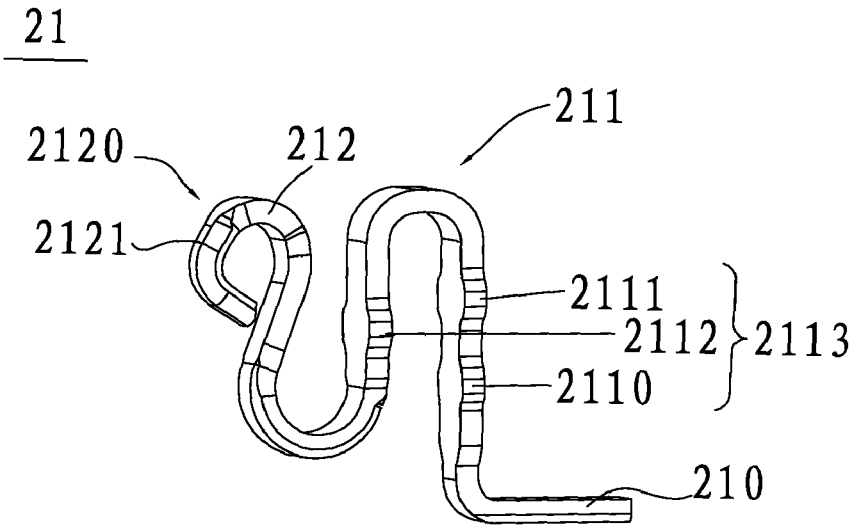
FIG. 4 is a schematic view of a female terminal in accordance with the present invention.
Figure 5:
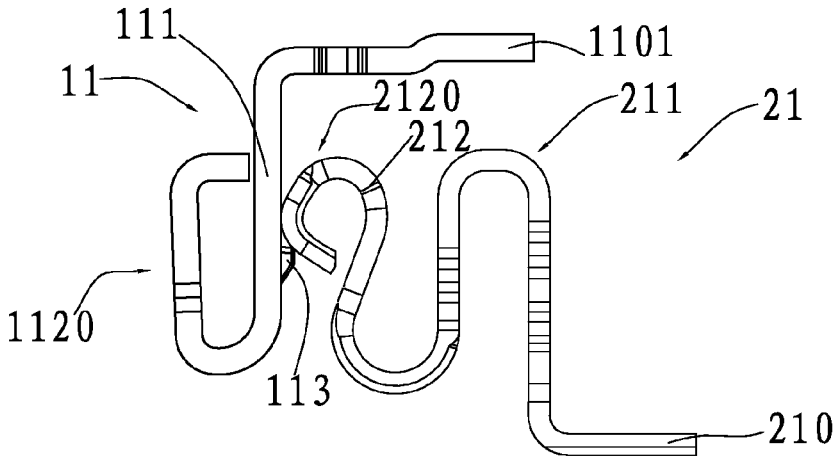
FIG. 5 is a schematic view illustrating the engagement of the male terminal with the female terminal.
Figure 6:
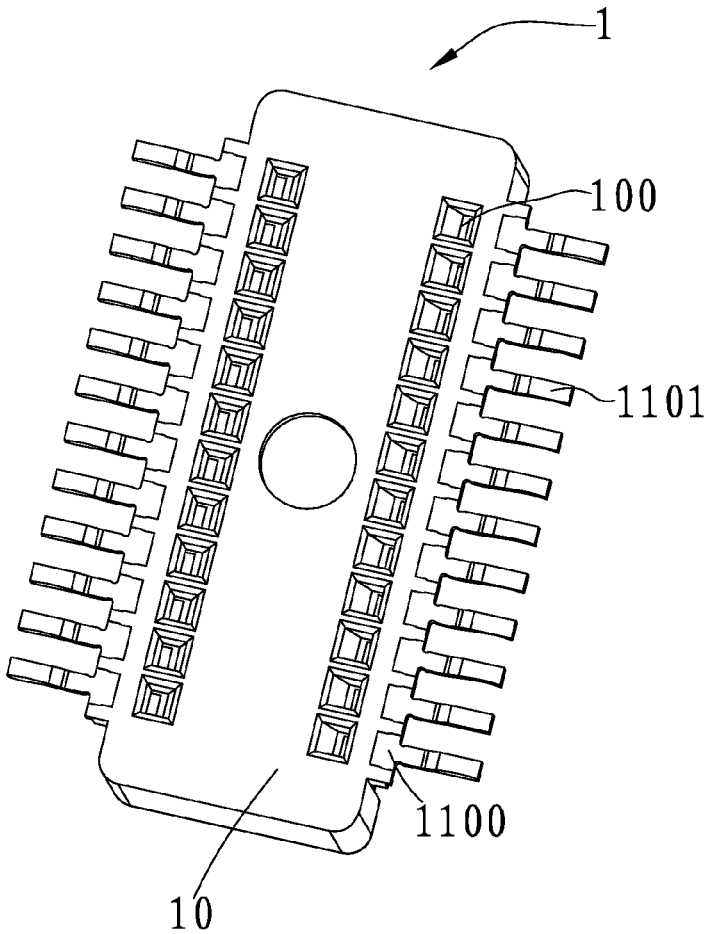
FIG. 6 is a schematic view of the male body in accordance with the present invention.
Figure 7:
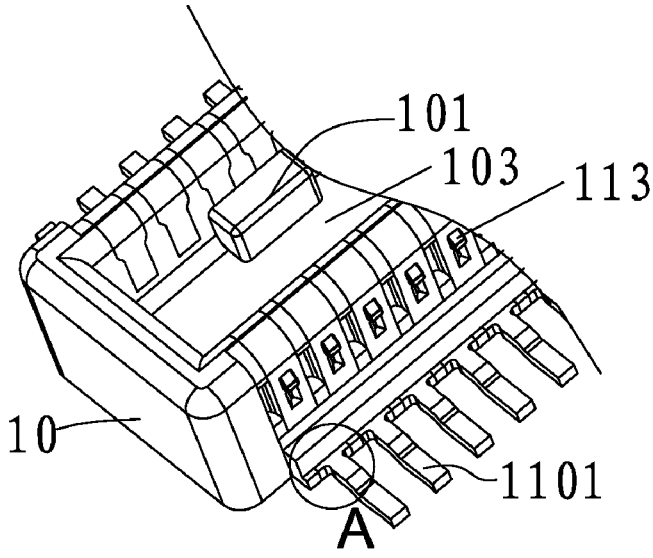
FIG. 7 is a schematic view of part of the male body in accordance with the present invention.
Figure 8:
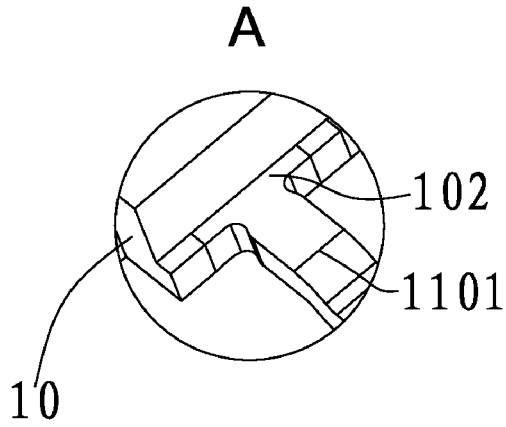
FIG. 8 is an enlarged view of Part A in FIG. 7.
Figure 9:
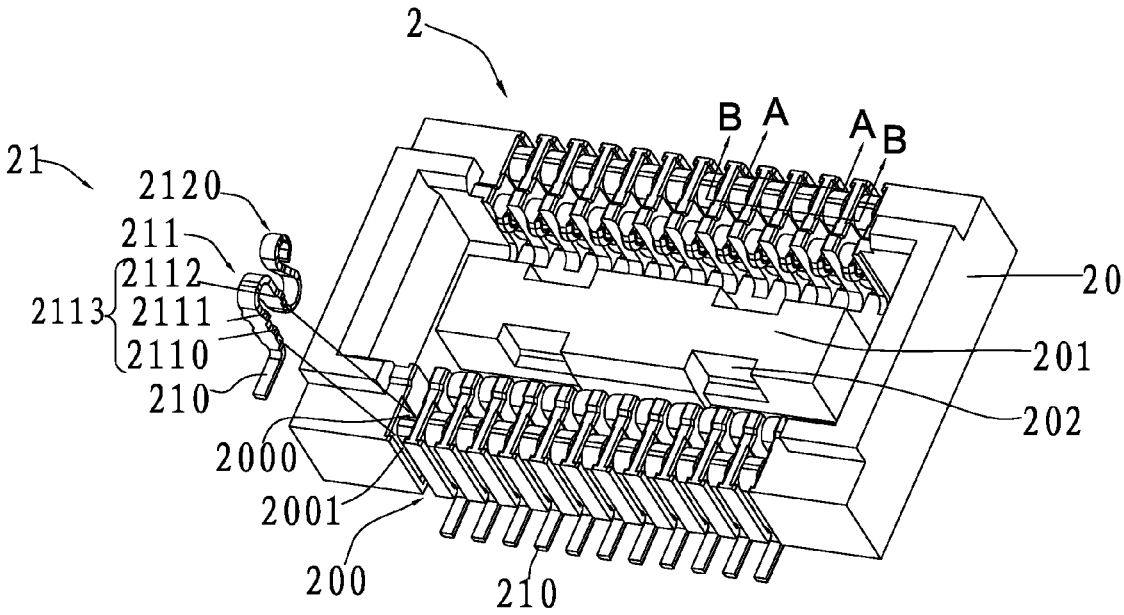
FIG. 9 is a schematic view illustrating the engagement of the female terminal with terminal slots.
Figure 10:
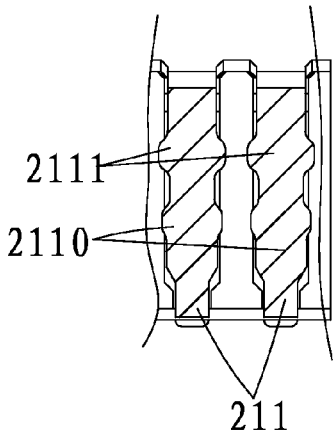
FIG. 10 is a sectional view of FIG. 9 along A-A direction.
Figure 11:
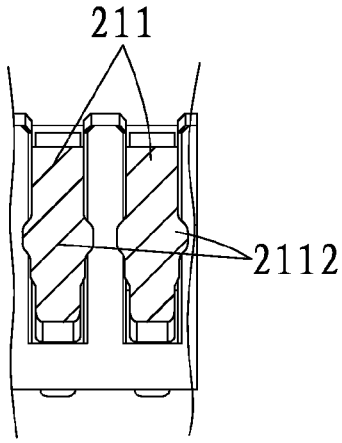
FIG. 11 is a sectional view of FIG. 9 along B-B direction.
Figure 12:
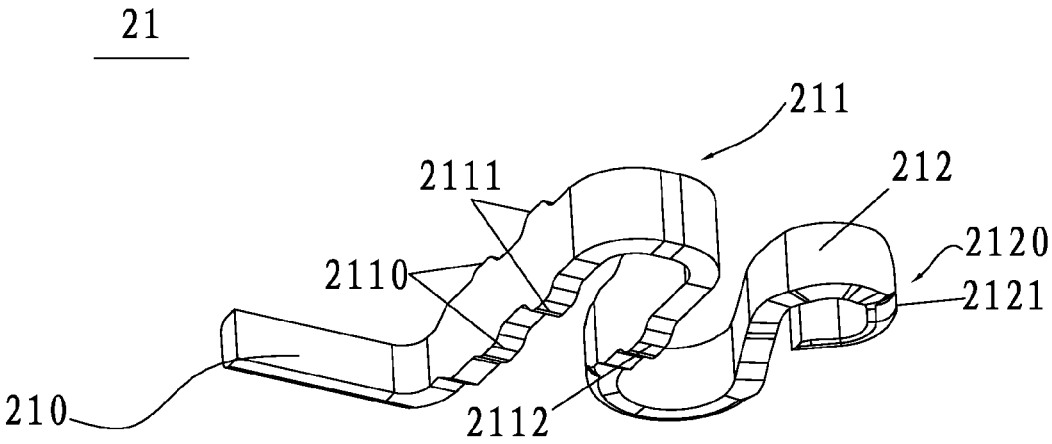
FIG. 12 is a perspective view of the female terminal.
Figure 13:
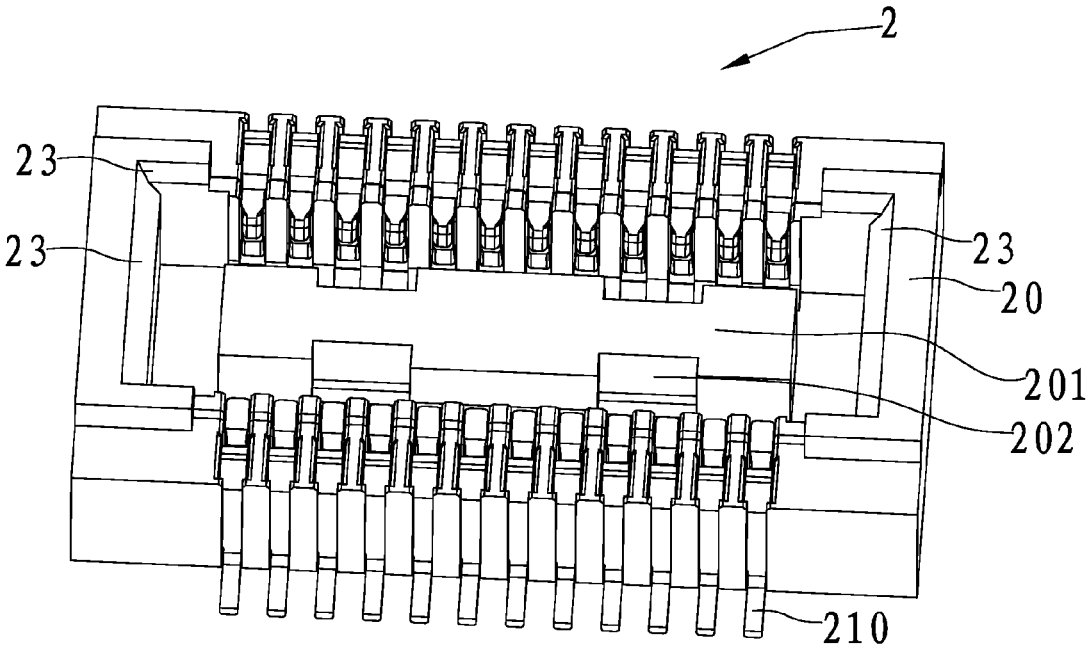
FIG. 13 is a schematic view of the female body in accordance with the present invention.
Figure 14:
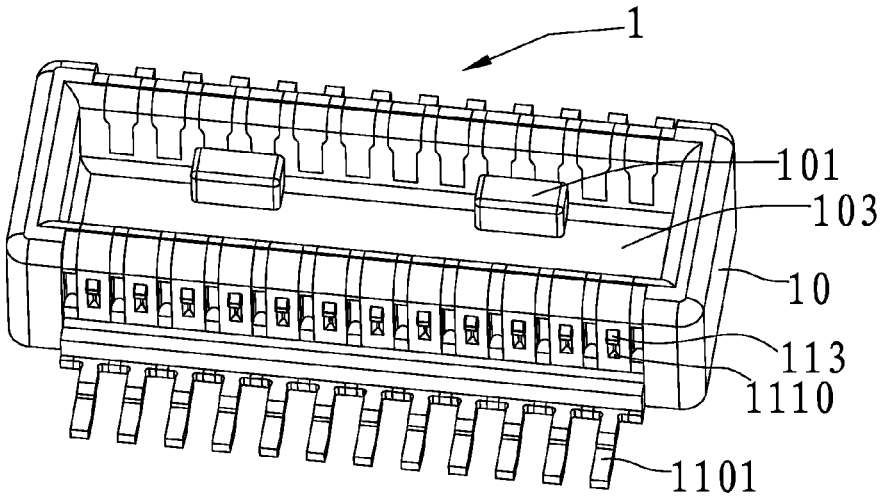
FIG. 14 is a schematic view of the male body in accordance with the present invention.

Referring to FIG. 1 to FIG. 14, the electrical connector in accordance with the present embodiment is composed of a male body 1 and a female body 2, both of which are flat-shaped.

The male body 1 mentioned above comprises a first insulating base 10 and a plurality of arrayed male terminals 11 integrally molded with the first insulating base 10. The female body 2 comprises a second insulating base 20 possessing terminal slots 200 arranged bilaterally and along the longitudinal direction and a plurality of arrayed female terminals 21 correspondingly arranged in the terminal slots 200.

Each male terminal 11 includes a male lead 110, a male contact 111 and a male arm 112. Each male lead is composed of a tail 1100 stationed on the first insulating base 10 and a head 1101 shooting out along its longitudinal direction with the width of the tail 1100 larger than that of the head 1101. The first insulating base 10 is formed with steps 102 at its joints with tail 1100 so that the male terminal 11 is safe from the damage that may be caused during the molding process.

The end of each male lead 110 is first bent and then extended to form the male contact 111 so that the male contact 111 is substantially vertical to the male lead 110. A protrusion 113 possessing a first slope 1130 inclining towards said female terminal 21 from bottom to top is soldered at the side surface of the male contact 111, the side surface facing female terminal 21. The protrusion 113 and the male lead 110 are on the same side of the male contact 111 and the first slope 1130 inclines towards the female terminal 21 so that it can make the insertion of the male body 1 to the female body 2 more smooth. A rectangular recess 1110 (which can be of other shapes) is formed above the protrusion 113 for holding at least part of the female terminal 21 so that the female terminal 21 can engage very stably with the male contact 111 and at the same time reducing the contact resistance therebetween and ensuring that the electrical circuit is through. The end of the male contact 111 is bent first and further extends in a direction opposite to said male lead 110 to form the male arm 112 which along with the male contact 111 forms a closed ring 1120. The first insulating base 10 owns a plurality of troughs 100 at the underside wall distant from the male body 2 for the reception of the said closed ring 1120 so that the male terminal 11 can be totally fixed to the first insulating base 10 leading to a higher productivity and a lower production cost. Besides, the male lead 110 is Z-shaped, which can ensure that the male terminal 11 be successfully tinned.

Each said female terminal 21 includes a female lead 210, a U-shaped female arm 211 and the female contact 212 extending from the female arm 211. The end of female contact 212 is bended to form a convex 2120, which is arc in its shape. Part of the convex 2120 can locate in the said trough 100 and another part of the convex 2120 just presses against the said protrusion 113 forming a close connection between the two. As a result, once the male body 1 and the female body 2 are connected, the male contact 111 and the female contact 212 are in a stable contacting state ensuring the high stability of the contact between the male terminal 11 and the female terminal 21.

Said convex 2120 is bended at many points, which can lengthen the force arm of the female terminal 21 and that the female terminal 21 will not collapse under force. The convex 2120 further possesses a second slope 2121 at the side facing the male contact 111, the second slope 2121 inclining towards the male contact 111 from top to bottom and plays the same role as the first slope 1130 to make the insertion of the male terminal 11 to the female terminal 21 more smooth.

Each terminal slot 200 is composed of an inner slot 2000 receiving the arm of the female arm 211 adjacent to the female lead 210 and an outer slot 2001 receiving the another arm of the female arm 211. The female arm 211 possesses teeth 2113 including a pair of first teeth 2110, a pair of second teeth 2111 and a pair of third teeth 2112 with the former two pairs of teeth located at the sidewall of the arm of the female arm 211 adjacent to the female lead 210 and the later one pair located at the side wall of the another arm. When inserting the female terminal 21 to the terminal slot 200, the first teeth 2110 interact with the sidewall of the terminal slot 200 firstly. The width of the first teeth 2110 is smaller than that of the second teeth 2111. The teeth 2113 can enhance the retention force of the female terminal 21 in the terminal slot 200.

The female contact 212 is narrowing gradually from its tail to its end with the trend inverted at the turning point, which can disperse the stress on the female terminals 21 during inserting process and prolong the life of the product. In addition, with a relatively narrow end, the female contact 212 can be oriented more precisely to contact with the male contact 111 and no misalignment occurs when connecting the male body 1 and the female body 2.

The inner sidewall of the two opening ends of the second insulating base 20 forms slopes 23 respectively resulting in a horn shaped opening. Correspondingly, the outer sidewall of the two opening ends of the first insulating base 10 form inverted round corner 12 respectively, which is helpful to the smooth insertion of the male body 1 to the female body 2. At the middle of the second insulating base 20 is a first rib 201 with four first grooves 202, while the first insulating base 10 possesses a second groove 203 with four bulges 101. The first rib 201 engages with the second groove 103 and the four bulges 101 engage with the four first grooves 202 respectively, by which the reliability of the contact between the male terminals 11 and the female terminals 21 are ensured.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims. Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. An electrical connector comprising:

a male body including a first insulating base, a plurality of male terminals arranged on said first insulating base, each male terminal having a male contact; and a female body including a second insulating base, and a plurality of female terminals arranged on said second insulating base, each female terminal having a female contact engaging with said male contact so that the external circuit can be made through;

wherein the male contact comprises a protrusion at its side surface and a recess above said protrusion, the end of said female contact facing said male contact is bent to form an arc-shaped convex which contacts with said male contact and engages with said protrusion in a locking manner, at least a portion of said convex positioned in said recess.

2. An electrical connector according to claim 1, wherein said second insulating base is formed with slopes at the inner sides of its two opening ends facing said male body, said slopes inclining towards the center of said second insulating base from top to bottom; and said first insulating base possesses rounding angles at its outside facing two opening ends of said second insulating base.

3. An electrical connector according to claim 1, wherein the second insulating base is formed with a first rib having at least one first groove, and the first insulating base is formed with at least one second groove having at least one bulge projecting thereof, said first rib inserting into said second groove, with said first groove accepting said bulge and engaging with the bulge tightly.

4. An electrical connector according to claim 1, wherein said protrusion is formed with a first slope inclining towards said convex from bottom to top, and at upside of the convex there is a second slope inclining towards said male contact from top to bottom.

5. An electrical connector according to claim 1, wherein said female contact is becoming narrower gradually from a distal end distant from said convex to the other end near to the convex.

6. An electrical connector according to claim 1, wherein said male terminal further comprises a male lead extending from one end of said male contact in a bending direction, and a male arm formed by bend forward and back of another end of said male contact, said male lead having a head part extending outwardly from said first insulating base and a tail part stationed on said first insulating base.

7. An electrical connector according to claim 6, wherein said first insulating base is formed with steps at its joints with said male lead.

8. An electrical connector according to claim 6, wherein said male arm together with part of said male contact forms a closed loop.

9. An electrical connector according to claim 1, wherein said female terminal further comprises an inverted-U-shaped female arm extending in a direction opposite to said male contact and a female lead extending from the female arm in a direction opposite to said male contact, and said second insulating base possesses a plurality of terminal slots set along its longitudinal direction for receiving said female arm.

10. An electrical connector according to claim 9, wherein said female arm is formed with teeth in a side surface for tight cooperation with sidewalls of said terminal slot.

11. An electrical connector comprising:

a male body including a first insulating base and a plurality of male terminals arranged on said first insulating base, each male terminal having a male contact; and a female body including a second insulating base and a plurality of female terminals arranged on said second insulating base, each female terminal having a female contact engaging with said male contact so that the external circuit can be made through;

wherein the male contact is formed with a protrusion extending from a side surface and a recess above the protrusion; an end of said female contact facing said male contact is bent to form an arc-shaped convex which contacts with said male contact and engages with said protrusion in a locking manner, at least a portion of said convex positioned in said recess.

12. An electrical connector according to claim 11, wherein said second insulating base is formed with slopes at inner sides of two opening ends facing said male body, said slopes inclining towards a center of said second insulating base from top to bottom; and said first insulating base comprises rounded edges at its outer ends facing said second insulating base.

13. An electrical connector according to claim 11, wherein the second insulating base is formed with a first rib having at least one first groove, and the first insulating base is formed with a cavity having at least one bulge projecting therefrom, said first rib inserting into said cavity, with said first groove accepting and engaging said bulge.

14. An electrical connector according to claim 11, wherein said protrusion is formed with a first slope inclining towards said convex from bottom to top, and an upper portion of the convex comprises a second slope inclining towards said male contact from top to bottom.

15. An electrical connector according to claim 11, wherein said female contact gradually becomes narrower from a distal end distant from said convex to another end near to the convex.

16. An electrical connector according to claim 11, wherein said male terminal further comprises a male lead extending from one end of said male contact in a bending direction, and a male arm comprising a loop, said male lead having a head portion extending outwardly from said first insulating base and a tail portion stationed on said first insulating base.

17. An electrical connector according to claim 11, wherein said female terminal further comprises an inverted-U-shaped female arm extending from an end of said female contact in a direction opposite to said male contact, and a female lead extending from said female arm in a direction opposite to said male contact, the female lead extending outwardly from said second insulating base, and said second insulating base possesses a plurality of terminal slots set along its longitudinal direction for receiving said female arm.

18. An electrical connector according to claim 17, wherein said female arm is formed with teeth extending from a side surface for engagement with sidewalls of said terminal slot.

* * * * *